US008910720B2

(12) United States Patent
Aguirre et al.

(10) Patent No.: US 8,910,720 B2
(45) Date of Patent: Dec. 16, 2014

(54) DOWNHOLE TOOL WITH ROLLER SCREW ASSEMBLY

(75) Inventors: Franz Aguirre, Missouri City, TX (US); Wade D. Dupree, Sugar Land, TX (US); Mark Holly, Sugar Land, TX (US); Derek Copold, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 86 days.

(21) Appl. No.: 13/378,480

(22) PCT Filed: Jun. 22, 2010

(86) PCT No.: PCT/US2010/039494

§ 371 (c)(1),
(2), (4) Date: Mar. 9, 2012

(87) PCT Pub. No.: WO2011/005519

PCT Pub. Date: Jan. 13, 2011

(65) Prior Publication Data

US 2012/0168176 A1 Jul. 5, 2012

Related U.S. Application Data

(60) Provisional application No. 61/219,073, filed on Jun. 22, 2009.

(51) Int. Cl.

| | |
|---|---|
| ***E21B 23/00*** | (2006.01) |
| ***E21B 4/18*** | (2006.01) |
| ***E21B 23/14*** | (2006.01) |

(52) U.S. Cl.

CPC . *E21B 4/18* (2013.01); *E21B 23/14* (2013.01); *E21B 2023/008* (2013.01)

USPC ..... 166/381; 166/241.1; 166/241.5; 175/51; 175/106; 310/80

(58) Field of Classification Search

USPC ..... 166/241.1, 381, 241.5, 378; 175/51, 175/106; 254/134.3 FT, 134.3 R, 134.4; 74/424.92; 310/80

See application file for complete search history.

(56) References Cited

U.S. PATENT DOCUMENTS

| | | | | |
|---|---|---|---|---|
| 2003/0173076 | A1 | 9/2003 | Sheiretov et al. | |
| 2003/0183383 | A1 | 10/2003 | Guerrero | |
| 2005/0263325 | A1 | 12/2005 | Doering et al. | |
| 2006/0175799 | A1* | 8/2006 | Heynssens | 280/414.5 |
| 2008/0308318 | A1* | 12/2008 | Moore | 175/51 |
| 2009/0071714 | A1* | 3/2009 | Shrestha | 175/20 |

* cited by examiner

*Primary Examiner* — Kenneth L Thompson
*Assistant Examiner* — Taras P Bemko
(74) *Attorney, Agent, or Firm* — Trevor Grove

(57) ABSTRACT

A downhole tool for positioning in a wellbore comprises a tool main body, an electric motor disposed within the tool main body, the motor comprising a rotor rotatably attached to a stator, and a linear actuator assembly disposed within the motor for transforming a rotary output of the motor into a linear displacement.

8 Claims, 7 Drawing Sheets

DOWNHOLE TOOL WITH ROLLER SCREW ASSEMBLY

CROSS-REFERENCE TO RELATED APPLICATIONS

This application is a 371 of international Application No. PCT/US10/39494, filed Jun. 22, 2010, which claims the benefit of U.S. Provisional Patent Application Ser. No. 61/219,073, filed Jun. 22, 2009. Each of the aforementioned related patent applications is herein incorporated by reference.

FIELD

Embodiments described herein relate to tractors for delivering tools through open-hole hydrocarbon wells. In particular, embodiments of tractors are described which employ techniques and features directed at the force exhibited between expansion mechanisms of the tractor and the uncased wall of the well

BACKGROUND

The statements in this section merely provide background information related to the present disclosure and may not constitute prior art Downhole tractors are often employed to drive a downhole tool through a horizontal or highly deviated well at an oilfield. In this manner, the tool may be positioned at a well location of interest in spite of the non-vertical nature of such wells. Different configurations of downhole tractors may be employed for use in such a well. For example, a reciprocating or "passive" tractor may be utilized which employs separate adjacent sondes with actuatable anchors for interchangeably engaging the well wall. That is, the sondes may be alternatingly immobilized with the anchors against a borehole casing at the well wall and advanced in an inchworm-like fashion through the well. Alternatively, an "active" or continuous movement tractor employing tractor arms with driven traction elements thereon may be employed. Such driven traction elements may include wheels, cams, pads, tracks, wheels or chains. With this type of tractor, the driven traction elements may be in continuous movement at the borehole casing interface, thus driving the tractor through the well.

Regardless of the tractor configuration chosen, the tractor, along with several thousand pounds of equipment, may be driven thousands of feet into the well for performance of an operation at a downhole well location of interest. In order to achieve this degree of tractoring, forces are imparted from the tractor toward the well wall through the noted anchors and/or traction elements. In theory, the tractor may thus avoid slippage and achieve the noted advancement through the well.

Unfortunately, advancement of the tractor through a well may face particular challenges when the well is of an open-hole variety as opposed to the above-described cased well. That is, in certain operations, the well may be uncased and defined by the exposed formation alone. In such circumstances, the well is likely to be of a variable diameter throughout. For example, it would not be uncommon to see an 8 inch well expand to over 11 inches and taper back to about 8 inches intermittently over the course of a few thousand feet. Thus, without the reliability provided by a casing of uniform diameter, the tractor is left with the proposition of radial expansion to interface a changing diameter of the open hole well wall in order to maintain tractoring.

In order to ensure that the radial expansion is sufficient to maintain tractoring in an open hole, an excess of expansion forces may be employed. So, with reference to the well above for example, the amount of force imparted on the tractoring mechanisms (e.g. anchor or bowspring arms) may be pre-set at an amount sufficient to expand and drive the tractor through an 11 inch diameter section of the well. Thus, the tractor may be expected to avoid slippage when the well diameter begins to expand from 8 inches up to 11 inches.

Unfortunately, while excess expansion force may ensure tractoring through larger diameter sections of the open hole well, this technique may also lead to damaging of the tractor. For example, a conventional tractor may be equipped with anchor arms configured to withstand maximum forces of about 5,000 lbs. However, in a circumstance where the anchor arms are pre-set to operate at about 4,500 lbs. through an 11 inch diameter open hole well, forces well in excess of 5,000 lbs. may be imparted on the arms as the tractor traverses 8 inch well sections as noted above. Mechanical failure of the tractor is thus likely to ensue as a result of over-stressed anchor arms.

Furthermore, even in circumstances where the anchor arms or other expansive mechanisms are of sufficient strength and durability to withstand excess forces as noted, the exposed formation defining the well may not be. That is, in many circumstances the application of excess force may result in damage to the exposed well wall when its compressive strength is exceeded. Thus, where the formation is comparatively soft in nature, the utilization of forces adequate to drive the tractor through an 11 inch diameter well section may damage an 8 inch diameter section. Nevertheless, the utilization of excess force is often employed to help ensure tractoring through a variable diameter open hole well is achieved. As a result, the well wall often collapses or cracks in certain locations even where the tractor is left undamaged. In fact, even though technically undamaged, the tractor may be rendered inoperable with its expansion mechanism imbedded within a collapsed section of the well. In such circumstances, not only is tractoring halted, but a follow-on high cost fishing operation may be required.

SUMMARY

A downhole tool for positioning in a wellbore comprises a tool main body, an electric motor disposed within the tool main body, the motor comprising a rotor rotatably attached to a stator, and a linear actuator assembly disposed within the motor for transforming a rotary output of the motor into a linear displacement. In an embodiment, the linear actuator assembly reduces the overall length of the downhole tool. In an embodiment, the downhole tool comprises a downhole tractor. The linear actuator may actuate a driving mechanism for interfacing with a wall of the wellbore. In an embodiment, the tool further comprises an expandable arm coupled to the driving mechanism for deploying the driving mechanism to interface with the wall of the wellbore. The driving mechanism may comprise at least one gripping arm for propelling the downhole tractor in an inchworm-like motion.

In an embodiment, the linear actuator assembly comprises an inverted roller screw assembly linearly driving a pushrod extending from the electric motor. The linear actuator assembly may further comprise a female threaded roller nut connected to the motor rotor and threadably connected to a roller carrier. The roller carrier may comprise at least one roller for threadably engaging the roller nut. In an embodiment, the electrical motor is connected to a source of electrical power via a wireline cable.

A method for reducing the length of a downhole tool assembly comprises providing a tool main body, disposing an electric motor within the tool main body, the motor comprising a rotor rotatably attached to a stator, and disposing a linear actuator assembly within the motor to reduce the overall length of the downhole tool, wherein the linear actuator assembly transforms a rotary output of the motor into a linear displacement. In an embodiment, providing a tool main body comprises providing a downhole tractor. The method may further comprise disposing the tool main body into the wellbore, actuating a driving mechanism with the linear actuator assembly and interfacing a wall of the wellbore and with the driving mechanism. The method may further comprise coupling an expandable arm to the to interface with the wall of the wellbore. The method may further comprise propelling the downhole tractor in an inchworm-like motion utilizing at least one gripping arm the driving mechanism comprises at least one gripping arm for.

In an embodiment, disposing a linear actuator assembly comprises disposing within the motor an inverted roller screw assembly linearly driving a pushrod extending from the electric motor. In an embodiment, disposing a linear actuator assembly further comprises connecting a female threaded roller nut to the motor rotor and threadably connecting the roller nut to a roller carrier. In an embodiment, connecting the roller nut further comprises carrier threadably connecting at least one roller on the roller carrier with the roller nut. In an embodiment, the method further comprises connecting the electrical motor to a source of electrical power via a wireline cable. In an embodiment, disposing an electric motor comprises disposing a brushless direct current motor within the tool main body.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Embodiments are described with reference to certain open-hole tractor assemblies. Focus is drawn to tractor assemblies that are of multiple sonde configurations. In particular, a reciprocating sonde type tractor employed in a downhole logging application is depicted with reference to embodiments described herein. However, a variety of tractor types and applications may be employed in accordance with embodiments of the present application. Regardless, embodiments detailed herein include a tractor that employs force monitoring techniques and features particularly suited for use in open-hole wells. As such, the structural integrity of the well may be substantially maintained over the course of tractoring operations. That is, forces may be employed in driving the tractor which are monitored and maintained at a level sufficient for driving without exceeding the ultimate compressive strength of the well wall resulting in substantial shearing thereat.

Figure 1:
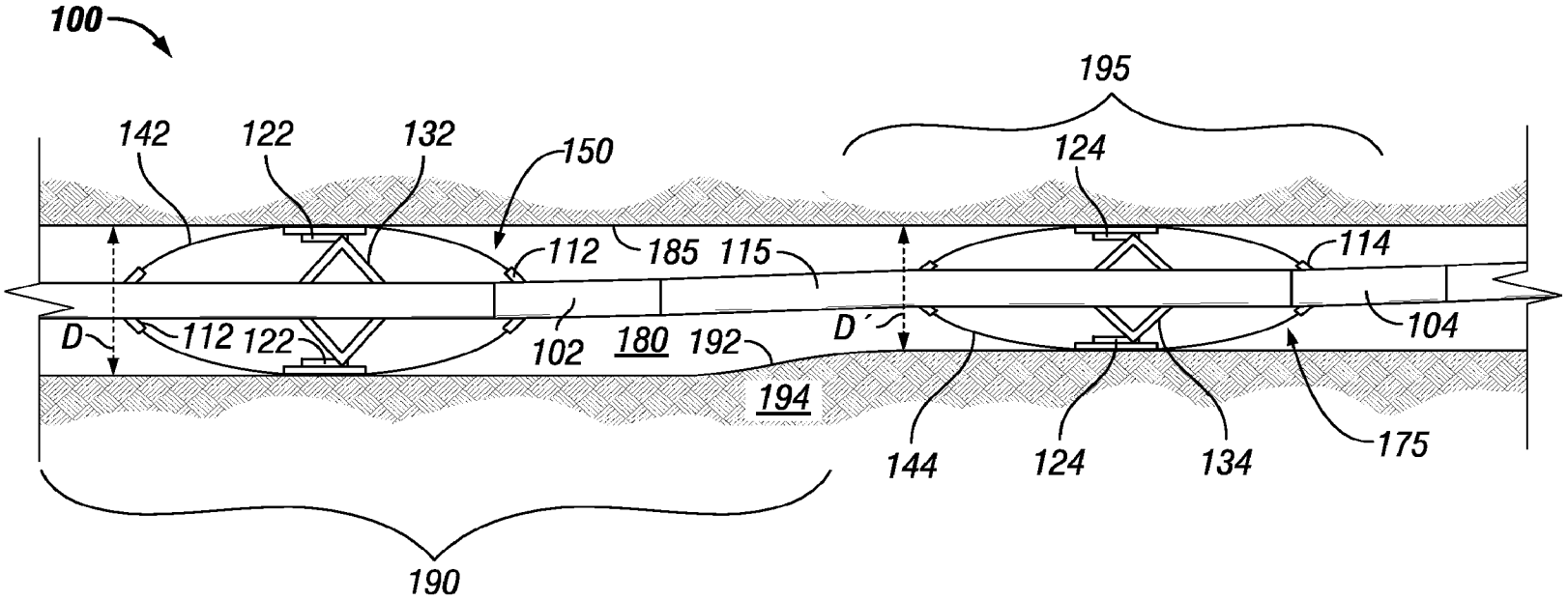
FIG. 1 is a side cross-sectional view of an embodiment of a force monitoring tractor disposed in an open-hole well.

Referring now to FIG. 1, a side cross-sectional view of an embodiment of a force monitoring tractor 100 is depicted disposed within an open-hole well 180. In the embodiment shown, the tractor 100 is of a multiple sonde variety with an uphole sonde 150 and a downhole sonde 175 to interface the well wall 185 and serve as the driving mechanism for the tractor 100. However, in other embodiments other types of tractor configurations, such as those employing tracks, wheels, chains, or pads as the tractor driving mechanism may be employed.

FIG. 1 reveals a variability in well diameter which is not uncommon to open-hole wells. For example, an uphole portion 190 of the well 180 is of a greater diameter (D) than the diameter (D') of a downhole portion 195 of the well 180. Furthermore, in the case of an open-hole well 180, the well wall 185 is no more than an exposed surface of the formation 194. Together, the combination of exposed formation 194 and smaller diameter (D') well portions leave the well 180 particularly susceptible to collapse and/or damage during intervention applications. However, as detailed below, the tractor 100 shown in FIG. 1 is equipped with a force monitoring capacity to control forces applied to the well wall 185 during tractoring through smaller diameter (D') well portions (e.g. at 195). Additionally, the tractor 100 may include gripping saddles 122, 124 configured to spread out the physical interfacing of the tractor 100 and well wall 185 over a greater area. In this manner, the likelihood of damage to the well wall 185 due to the forceful contact of the tractor 100 may be minimized.

Continuing with reference to FIG. 1, the tractor 100 is made up of an elongated body 115 or shaft to accommodate each sonde 150, 175. The sondes 150, 175 in turn are made up of bowsprings 142, 144 which are coupled to the body 115 via movable couplings 112, 114 as shown. Radially expandable arms 132, 134 are disposed between the couplings 112, 114 of each bowspring 142, 144 to forcibly engage the well wall 185 in an alternating fashion. As such, the tractor 100 may proceed downhole in an inchworm-like manner. Such is the nature of a reciprocating tractor 100 of multiple sonde configuration.

As noted above, the well 180 is of an open-hole variety. As such, the emergence of a step 192 or change in well morphology and/or diameter (e.g. (D) vs. (D')) may be a common occurrence. With this in mind, the tractor 100 is also equipped with force monitoring mechanisms 102, 104 associated with each sonde 150, 175. As detailed further below, these mechanisms 102, 104 may be employed to help ensure that the forcible engagement directed by the expandable arms 132, 134 does not exceed a predetermined amount, irrespective of the well diameter at any given location. As such, the structural integrity of the open-hole well 180 may be largely left intact, in spite of the noted tractoring.

Figure 2:
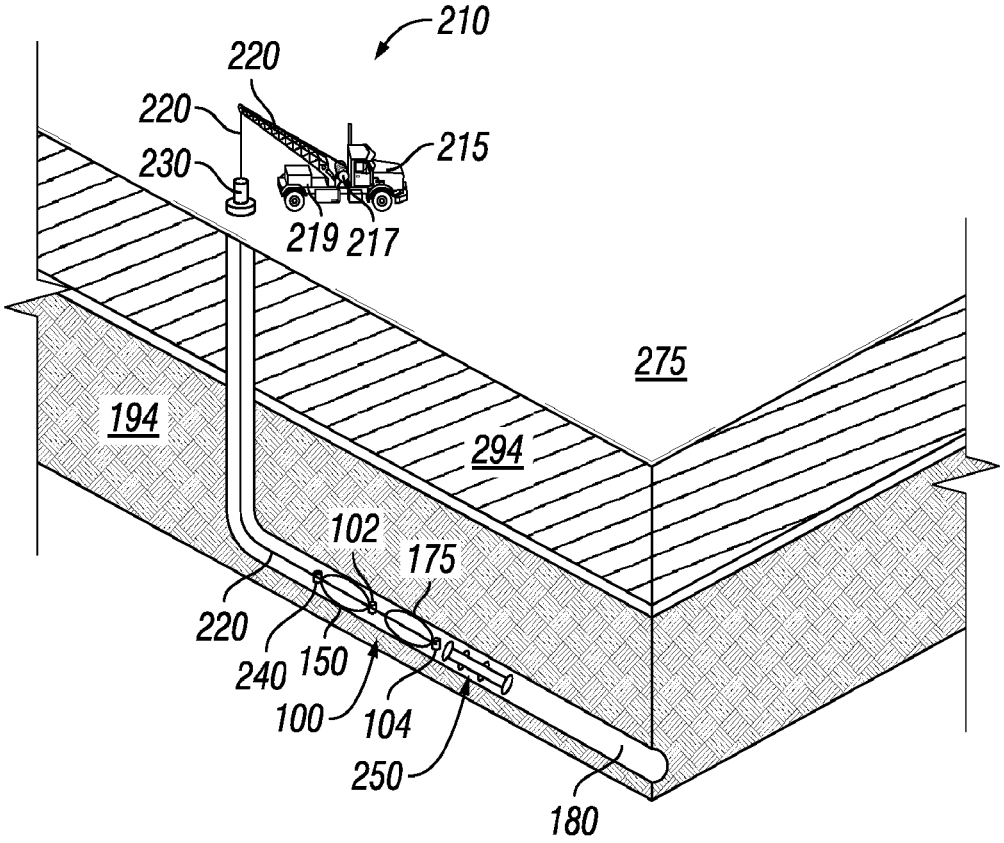
FIG. 2 is a perspective overview of an oilfield accommodating the open-hole well with force monitoring tractor of FIG. 1.

Referring now to FIG. 2, a larger overview of the tractoring is depicted. In this depiction it is apparent that the open hole well 180 runs through the formation 194 well below other formation layers 294 at an oilfield 275. In the embodiment shown, the tractor 100 is deployed from the surface of the oilfield 275 via a conventional wireline 220. However, other forms of well access line may be employed. As shown in FIG. 2, several thousand feet of wireline 220 may be run from wireline equipment 210 through a wellhead 230 at the oilfield 275 and to the tractor 100 as shown. The equipment may include a conventional wireline truck 215 configured to accommodate a drum 217 from which the wireline 220 may be drawn. In the embodiment shown, control equipment 219 is also provided by way of the truck 215 to direct the deployment of the wireline 220 and associated tractoring.

A reciprocating tractor 100 may be particularly adept at delivering a downhole tool 250 to a location as shown in FIG. 2. For example, the location may be of relatively challenging access such as a horizontal well section several thousand feet below surface as depicted. In such circumstances, the amount of load pulled by the tractor 100 may exceed several thousand pounds and continually increase as the tractor 100 advances deeper and deeper into the well 180. However, the tractor 100 may be adequately powered by the wireline 220 and secured thereto through a conventional logging head 240. Thus, tractoring may proceed with the uphole sonde 150 and downhole sonde 175 interchangeably grabbing and gliding relative to the well wall so as to pull the entire assembly further and further downhole. So, for example, logging of the well 180 may proceed in an embodiment where the downhole tool 250 is a logging tool. Once more, due to the force monitoring mechanisms 102, 104 associated with the sondes 150, 175, the logging application may take place without substantial damage to the open hole well 180 as a result of the tractoring.

Figure 3:
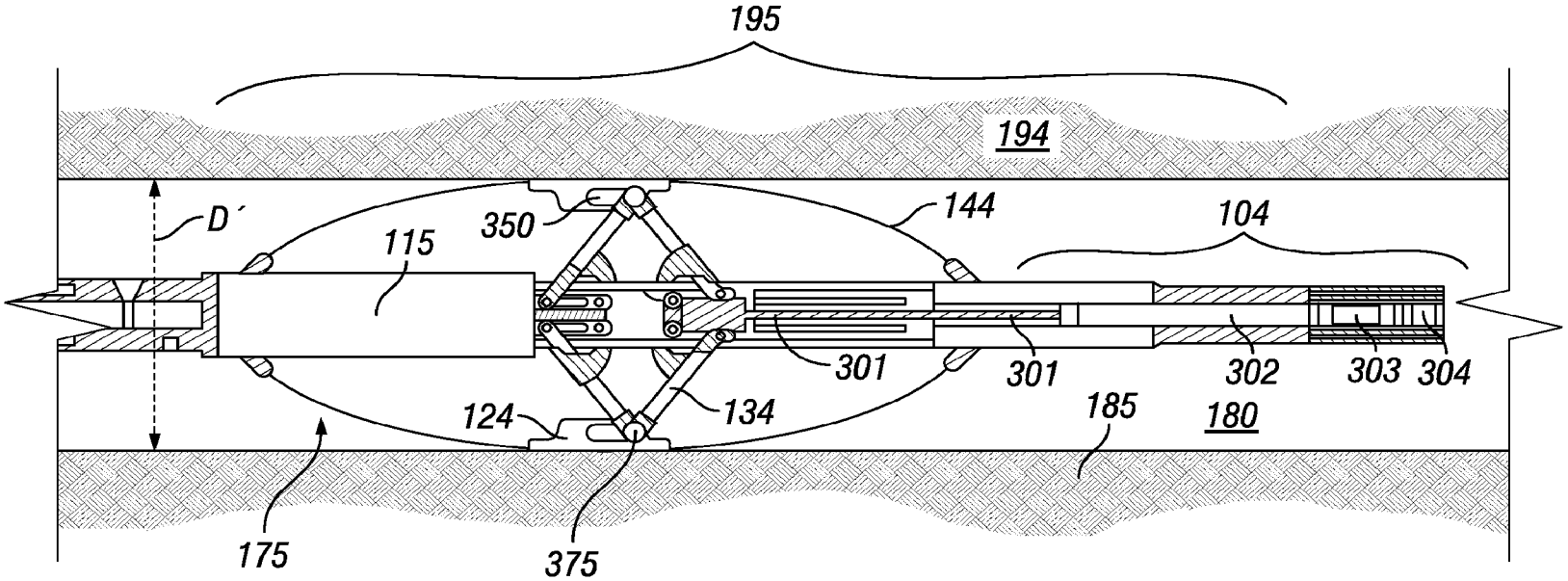
FIG. 3 is an enlarged cross-sectional view of a downhole sonde of the force monitoring tractor of FIG. 1 in the open-hole well.

Referring now to FIG. 3, an enlarged cross-sectional view of the downhole sonde 175 is depicted within the smaller diameter (D') downhole portion 195 of the well 180. The force monitoring mechanism 104 of the sonde 175 may play a significant role in regulating the physical interaction of the sonde 175 and the well wall 185. That is, consider that the bowsprings 144 of the sonde 175 may be set to expand for gripping the wall 185. However, the diameter (D') of the well 180 is reduced in the downhole portion 195. Thus, the force monitoring mechanism 104 may be employed to ensure that the force of this expansion does not exceed a predetermined amount. In this manner, damage to the exposed well wall 185 may be avoided as the gripping saddles 124 of the bowsprings 144 grab hold of the wall 185 for pulling the assembly downhole.

Continuing with reference to FIG. 3, the force monitoring mechanism 104 includes a pressure sensor 303 such as a transducer for monitoring the pressure and/or force translated through the bowsprings 144 during operation. More specifically, the pressure sensor 303 may be coupled to a hydraulic chamber 302 that is in communication with a piston 301. While the depicted force monitoring mechanism 104 is pressure-based, alternate embodiments may be strain gauge based or include other suitable detection mechanisms.

As shown, the piston 301 may be directly coupled to the radially expandable arms 134 that forcibly control the interfacing of the bowsprings 144 and the wall 185. Thus, as the diameter (D') of the well 180 decreases and the force on the bowsprings 144 increases, the piston 301 may be forced toward the chamber 302. As such, hydraulic pressure in the chamber 302 may be driven up in a manner detectable by the pressure sensor 303. In one embodiment, the pressure in the chamber may be in the neighborhood of 7,500-12,500 psi. Such pressure may be recorded and interpolated by a downhole processor 304 as described below to determine roughly the amount of force translating through the bowsprings 144.

The force information obtained by the pressure sensor 303 may be employed in a variety of manners. For example, the sensor 303 may be coupled to a downhole processor 304 as indicated. Thus, the information may be recorded and relayed uphole (e.g. over the wireline 220 of FIG. 2). In this manner, well diameter and/or sonde and tractor location information may be retrieved and utilized. That is, by having a predetermined map of the well 180 geometry knowing the well diameter may be used to determine the tractor location. Additionally, as indicated above, the information may be employed to control the amount of force translated through the bowsprings 144 so as to minimize damage to the well wall 185 during tractoring. For example, upon acquiring information indicative of forces exceeding a predetermined amount, the processor 304 may be employed to direct release of fluid from the chamber 302 via conventional means. In this manner, the pressure on the piston 301, and ultimately the forces translated through the bowsprings 144, may be reduced.

With added reference to FIGS. 1 and 2, the tractor 100 may be configured to pull a load of several thousand pounds to deep within the well 180. Thus, sufficient forces necessary for tractoring are to be employed. However, given the exposed, open-hole nature of the well 180, the tractor 100 may also be configured to avoid excessive translation of forces through any of the bowsprings 142, 144 to the well wall 185. With reference to controlling forces through these bowsprings 142, 144, a more specific illustration is described below.

In one embodiment, a predetermined target of about 5,000 psi of pressure may be set to ensure a sufficient, but not damaging, amount of pressure be translated through anchored bowsprings 142, 144 during a power stroke of the respective sonde 150, 175. For example, the ultimate compressive strength of the formation 194 may be about 5,250 psi. In such an embodiment, the downhole processor 304 may effectuate a deflation or release of fluid from the chamber 302 once pressure greater than a predetermined value of about 5,000 psi are detected by the pressure sensor 303. For example, as the downhole sonde 175 moves from a 10 inch uphole portion 190 of a well 180 and into an 8 inch portion 195, pressure translated through the bowsprings 144 may initially increase. However, the release of fluid from the chamber 302 will allow pressure to return to the targeted 5,000 psi. Similarly, the processor 304 may direct inflating or filling of the chamber 302 as described below, once pressure less than about 5,000 psi are detected. All in all, a window of between about 4,800 psi and about 5,200 psi of pressure through the bowsprings 144 may be maintained throughout a powerstroke of a given sonde 175.

In the example provided above, a powerstroke is noted as the period of time in which a given sonde 150, 175 is anchored to the well wall 185 by the forces translated through the bowsprings 142, 144. It is this anchoring force that is monitored by the noted mechanisms 102, 104. At other times during reciprocation of the tractor 100, however, a given sonde 150, 175 may be intentionally allowed to glide in relation to the well wall 185. Indeed, at any given point, one sonde 150, 175 may be anchored as the other glides, thereby leading to the inchworm-like advancement of the tractor 100 downhole as alluded to earlier.

It is worth noting that during the glide of a sonde 150, 175 (e.g. it's 'return stroke'), the amount of forces translated between the bowsprings 142, 144 and the wall 185 drops to well below the window of between about 4,800 psi and about 5,200 psi, for example. Further, regulation of such forces during the return stroke may be controlled by features outside of the force monitoring mechanisms 102, 104. In another embodiment however, these mechanisms 102, 104 may be employed to initiate the glide of the sonde 150, 175 for the return stroke. Additionally, upon returning to the power stroke a brief amount of inflating of the chamber 302 may take place to allow for sufficient anchoring forces to build up therein. Such inflating may take place in conjunction with the natural reciprocation of the tractor 100.

Figure 4:
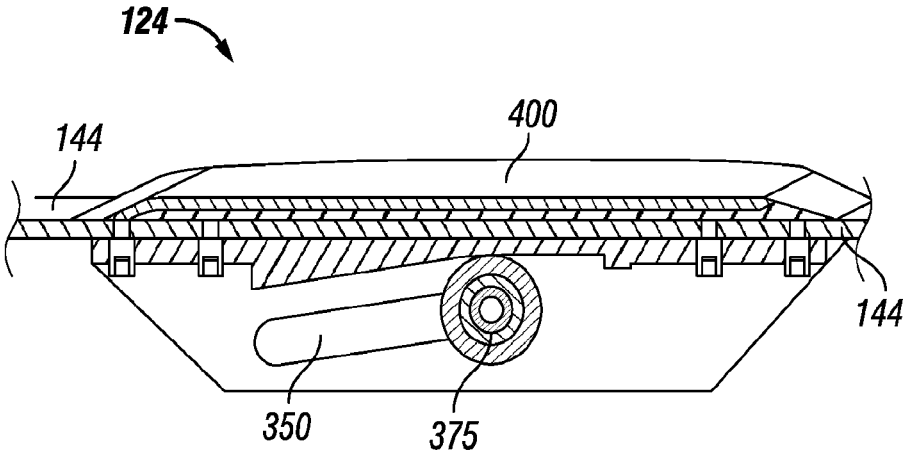
FIG. 4 is an enlarged view of a gripping saddle of the downhole sonde of the force monitoring tractor depicted in FIG. 3.

Continuing now with added reference to FIG. 4, one of the gripping saddles 124 of the downhole sonde 175 is described in greater detail. That is, in addition to employing the force monitoring mechanism 104, a specially configured gripping saddle 124 may be utilized to help minimize damage to the wall 185 of the well 180 during anchoring. In particular, the gripping saddle 124 includes a surface 400 that is configured to interface the well wall 185 across a wide area. That is, rather than provide a toothed cam or other conventional interfacing feature, the surface 400 spreads out interfacing contact between the radially forced bowspring 144 and the wall 185. Thus, a potentially damaging and forcibly induced line or point of contact between the bowspring 144 and wall 185 is avoided. Stated another way, the saddle 124 is configured to contact the wall 185 in a non-point and line manner for protection thereof. In one embodiment, the surface 400 is even of a comparatively harder material such as tungsten carbide.

With added reference to FIG. 3, the gripping saddle 124 is coupled to the sonde 175 via a linkage wheel 375 of the radially expandable arms 134. As shown, the linkage wheel 375 extends from the arms 134 and through a recess 350 of the saddle 124. The recess 350 of the embodiment shown is of an inclined orientation such that downhole movement of the wheel 375 takes place in conjunction with outward radial forces of expansion on the bowspring 144. This may enhance stable anchoring during a power stroke relative to the sonde 175.

Continuing with reference to FIGS. 3 and 4, the sonde 175 is shown for interfacing, and during a power stroke, anchoring relative to the well wall 185. However, both a force monitoring mechanism 104 and a gripping saddle 124 are provided. Alone, each of these features 104, 124 may substantially avoid the collapse of the formation 194 as a result of tractoring. However, when employed in conjunction with one another, the mechanism 104 and saddle 124 may substantially eliminate all reasonable likelihood of well damage at the wall 185 due to forces imparted by the sonde 175 during tractoring.

Figure 5:
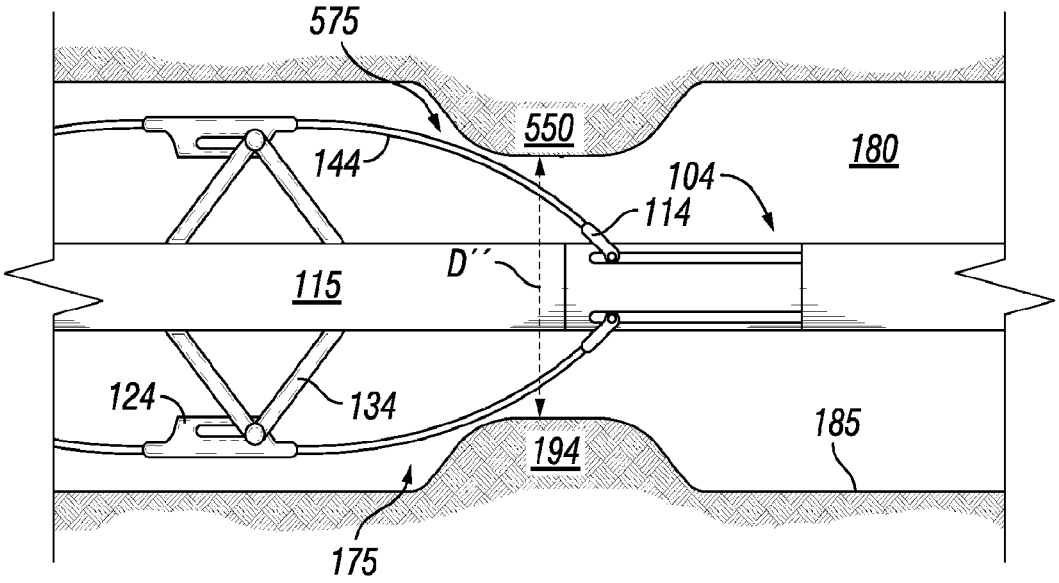
FIG. 5 is an enlarged cross-sectional view of the downhole sonde disposed adjacent a restriction of the open-hole well of FIG. 1.

Referring now to FIG. 5, the downhole sonde 175 is shown advanced further into the well 180 reaching a restriction 550. As described here, the term "restriction" is meant to refer to the presence of a feature that carries with it a sudden reduction in well diameter (D"). For example, given the open-hole nature of the well 180 depicted in FIG. 5, the restriction 550 may be a natural build-up of stable formation debris. However, in other circumstances, valves or other hydrocarbon well features may be pre-positioned downhole. Regardless, the well diameter (D") may shrink in a sudden manner as indicated such that the bowsprings 144 make contact with the restriction 550, such as at midpoint 575, in absence of the gripping saddles 124. That is, there may be a sudden emergence of force translated through the bowsprings 144 from a non-axial location (e.g. outside of the gripping saddles 124). Nevertheless, biasing toward such a location may be effectively achieved.

Figure 6:
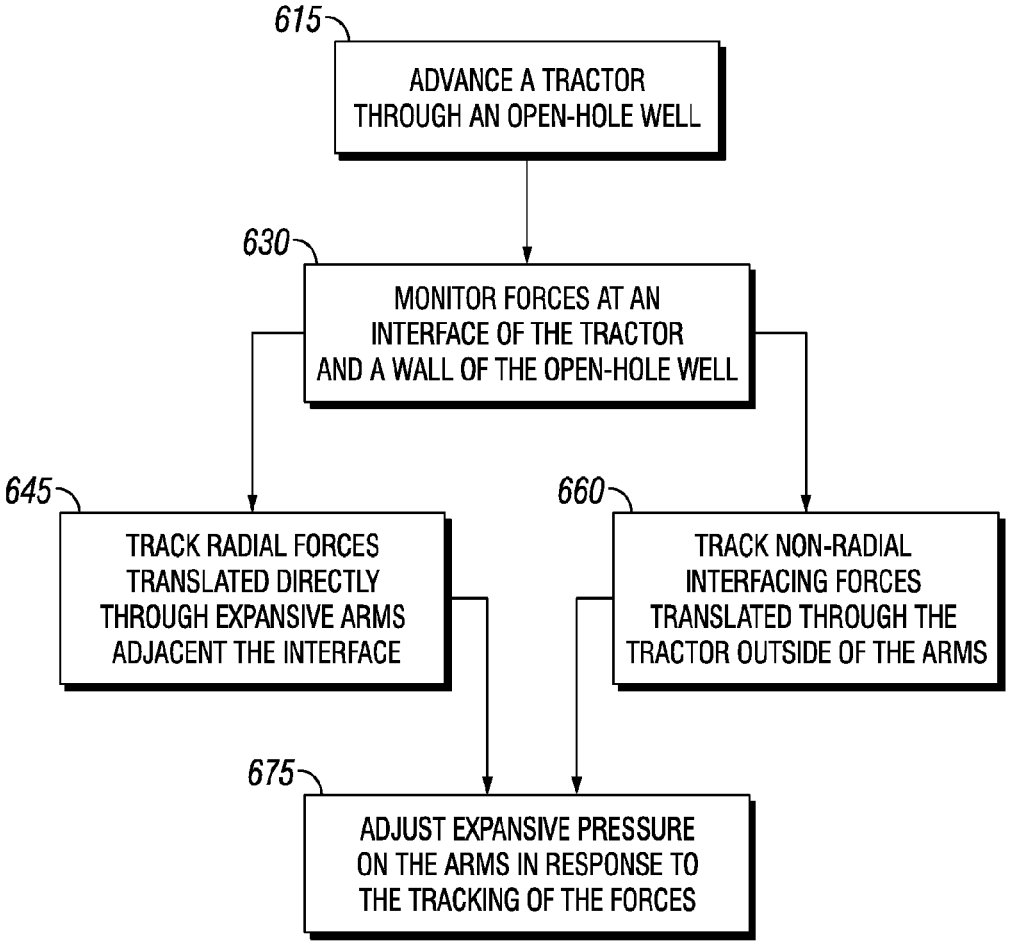
FIG. 6 is a flow-chart summarizing an embodiment of employing a force monitoring tractor in an open-hole well.

Referring now to FIG. 6, a flow-chart is depicted summarizing an embodiment of employing a force monitoring tractor in an open-hole well. The tractor may be advanced in the well as indicated at 615 while forces that are translated through the tractor relative to the wall of the well are continuously monitored as indicated at 630. This monitoring may provide a host of information relative to the well, tractor positioning therein, etc.

Monitoring of forces relative to the interface may also involve the tracking of truly radial forces that are translated directly through expansive arms that extend from a central elongated body of the tractor as noted at 645. This is detailed herein with reference to FIG. 3 and the tracking of forces that are translated through radially expansive arms (e.g. 134).

Alternatively, monitored forces at the interface may involve the tracking of forces that are imparted through the tractor without primarily being directed through the radially expansive arms (e.g. non-radial forces) as noted at 660. An example of monitoring of such forces is detailed herein with respect to FIG. 5.

Regardless of the particular type or combination of monitoring employed, the information obtained may be employed to adjust expansive pressure on the arms as indicated at 675. In this manner, the forces present at the interface of the tractor and the exposed surface of the open hole well may be regulated in a manner that optimizes tractoring while preserving the structural integrity of the formation as much as possible.

Embodiments detailed hereinabove provide techniques and assemblies that allow for tractoring in an open hole well in a manner that address concern over forces present at the interface of the tractor and the wall of the well. Such forces may be monitored and controlled in a manner that promotes the life of the tractor as well as the structural integrity of the exposed well wall surface.

Figure 7:
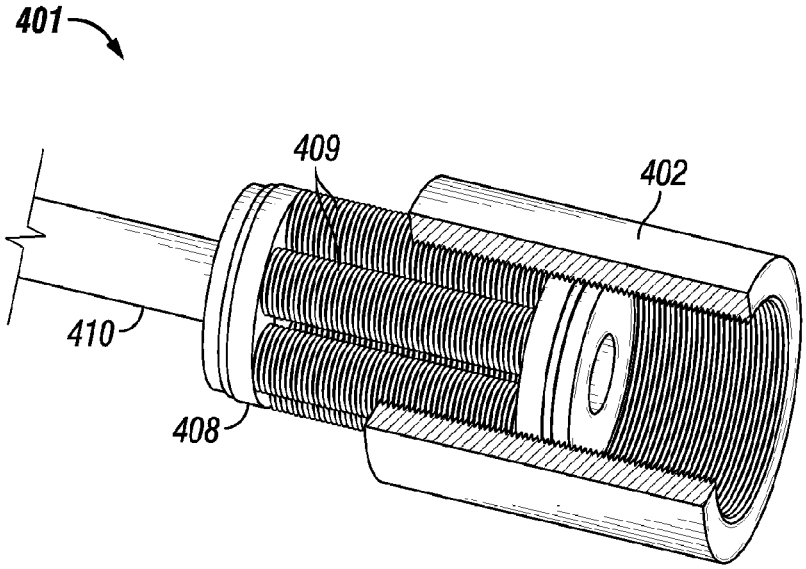
FIG. 7 is a schematic perspective view of a portion of a roller assembly.
Figure 8:
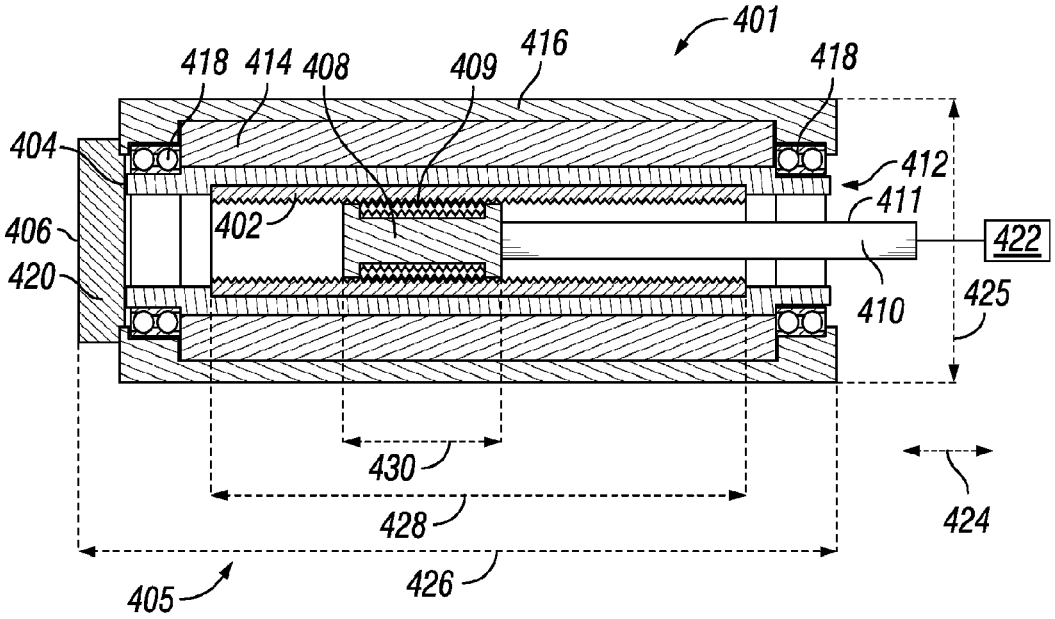
FIG. 8 is a schematic cross sectional view of a roller assembly and 8 show an inverted roller screw according to one embodiment.
Figure 9:
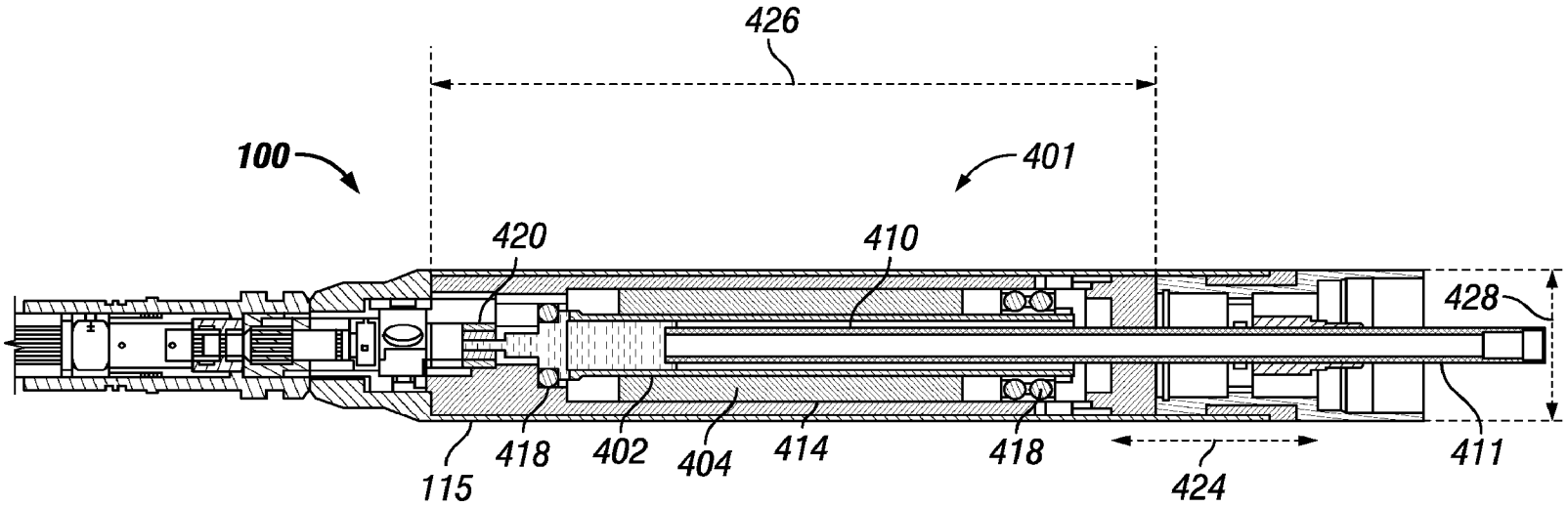
FIG. 9 is a schematic cross sectional view of a roller assembly installed in a tool body.

In order to effectuate the above described inchworm-like motion of the tractor, a linear action mechanism is desirable. That is, as one of the gripping saddles 122, 124 is engaged with the well wall 185, a linear actuator connected to the main body 115 of the tractor 100 can cause a forward propulsion of the tractor 100 relative to the well wall 185 by moving a linear actuator mechanism and thus the entire tractor 100 and/or tool 250, as the gripping saddle 122 or 124 engages the well wall 185. However, in some instances, it is desirable for the linear actuator to be short in length so that the overall length of the tractor 100 can be minimized. The embodiment of FIGS. 7-9 show an inverted roller screw assembly or linear actuator assembly 401 which may function as a linear actuator to propel the tool, such as the tool 250, while simultaneously enabling a minimization of the overall tool 250 and tractor 100 length, discussed in more detail below. That is, the sondes 150, 175 may be alternatingly immobilized with the anchors against a wellbore or a borehole casing at the well wall and advanced in an inchworm-like fashion through the well.

Referring now to FIGS. 7-9, an inverted roller screw assembly is indicated generally at 401. The assembly 401 comprises a roller nut 402 having threads formed on an interior diameter thereof. An exterior surface of the roller nut 402 is affixed to an interior surface of a rotor 404 of an electric motor 405 that is electrically connected to a suitable source of electrical power, indicated schematically at 406. The source of electrical power may be provided by a wireline cable or the like. The motor 405 may be a direct current brushless motor or any suitable motor, as will be appreciated by those skilled in the art. Disposed within the roller nut 402 is a roller carrier 408 having a pushrod 410 attached thereto and extending therefrom. The roller carrier 408 includes at least one roller 409 having threads on an exterior surface thereof for engaging with the internal threads of the roller nut 402. The rotor 404 is disposed in a cavity 412 defined by a stator 414 and stator housing 416 and is rotatably supported by a pair of bearings 418, such as roller bearings or other suitable bearings. A resolver 420 is attached to an end of the assembly 401 for directing current from the electrical power source 406 to windings and/or magnets of the rotor 402 and the stator 414 to rotate the rotor 402, as will be appreciated by those skilled in the art. A free end 411 of the pushrod 410 extends from the cavity 412 and beyond the exterior surface of the rotor 404, the stator 414, and the stator housing 416. A load, indicated schematically at 422, is attached to the free end 411 of the pushrod 410. The load 422 may comprise, but is not limited to, a linear actuator for imparting linear motion to the tractor body 115 of the tractor 100 and ultimately to the gripping saddles 122, 124 for providing forces for inchworm-like propulsion of the tractor 100.

The assembly 401 may be disposed within the body 115 of the tractor 100 and the stator housing 416 may be affixed to the body 115 of the tractor 100, best seen in FIG. 9. In operation, the motor 406 rotates the rotor 404 and roller nut 402 within the stator 414 and stator housing 416. As the roller nut 402 rotates, the internal threads of the roller nut 402 engage with the external threads on the roller or rollers 409 on the roller carrier 408 and, depending on the direction of rotation of the rotor 404 and roller nut 402 (as determined by the resolver 420 or suitable control system for the tractor 100) the roller carrier 408 and thus the pushrod 410 will extend or retract, as indicated by the arrow 424, in order to provide a force to the load 422, such as the linear actuator 422, a downhole or wellbore tool 250, or the like.

By attaching the assembly 401 comprising the roller carrier 408 to the main tractor body 115, forward propulsions of the tractor 100 may be accomplished. Such an embodiment trades length for diameter, as the overall diameter of the motor 405, indicated by an arrow 425, will increase by the respective diameters of the roller nut 402 and roller carrier 408. That is, the embodiment ultimately results in a larger outside diameter of the tool, as shown by an arrow 428, but a shorter overall length of the tool, as the length of the assembly 401, indicated by an arrow 426, is reduced by disposing the entire length of the roller nut 402, indicated by an arrow 428, within the motor 405. The effective stroke length of the assembly 401 (i.e., the amount of distance that the pushrod 410 may be extended from the assembly 401) is the length 428 of the roller nut 402 subtracted by the length of the roller carrier 408, indicated by an arrow 430. In some prior art linear actuators, a roller nut assembly is disposed adjacent an electric motor and driven by a gearbox or the like, which adds the length of the gearbox and the roller screw to the overall length of the tool. Furthermore, in some prior art linear actuators, the pushrod comprised threads on an exterior surface thereof that were engaged by internal threads of a roller nut. Reducing the overall length of the tool, as mentioned above, may be desirable in certain situations. Those skilled in the art will appreciate that the assembly 401 may be utilized with in a variety of wellbore applications including an actuator for an open hole tractor, such as the tractor 100, an actuator for a cased hole tractor, or any suitable wellbore tool where an overall length of the wellbore tool may be reduced while providing a linear actuator for the tool 250, such as a tool for actuating a coring tool, a tool for actuating a drilling tool, a tool for creating mud pulse telemetry pulses, or similar downhole tools, as will be appreciated by those skilled in the art.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. As such, the foregoing description should not be read as pertaining only to the precise structures described and shown in the accompanying drawings, but rather should be read as consistent with and as support for the following claims, which are to have their fullest and fairest scope.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A downhole tool for positioning in a wellbore, comprising:

a tool main body;

an electric motor disposed within the tool main body, wherein the electric motor comprises a motor housing, and wherein a stator and rotor are disposed within the motor housing, and wherein the rotor is rotatably attached to the stator; and a linear actuator assembly comprising an axially moveable roller carrier having at least one roller for connecting with a roller nut, wherein the roller nut is connected with the rotor, and wherein the roller carrier, roller nut, and roller are contained within the motor housing, wherein a push rod is connected with the roller carrier and moves axially in tandem with the roller carrier, and wherein the push rod at least partially extends out of the motor housing.

2. The downhole tool of claim 1 wherein the linear actuator assembly reduces the overall length of the downhole tool.

3. The downhole tool of claim 1 wherein the downhole tool comprises a downhole tractor.

4. The downhole tool of claim 3 wherein the linear actuator actuates a driving mechanism for interfacing with a wall of the wellbore.

5. The downhole tool of claim 4 further comprising an expandable arm coupled to the driving mechanism for deploying the driving mechanism to interface with the wall of the wellbore.

6. The downhole tool of claim 1 wherein the roller nut has female threads.

7. The downhole tool of claim 1 wherein the electrical motor is connected to a source of electrical power via a wireline cable.

8. A downhole tool for positioning in a wellbore, comprising:

a tool main body;

an electric motor disposed within the tool main body, wherein the electric motor comprises a motor housing, and wherein a stator and rotor are disposed within the motor housing, and wherein the rotor is rotatably attached to the stator; and a linear actuator assembly comprising:

a roller nut affixed to an interior surface of the rotor, wherein the roller nut is located within the motor housing;

an axially moveable roller carrier operatively engaged with the roller nut, wherein the roller carrier is located within the housing; and a push rod connected with the roller carrier, wherein the push rod moves axially in tandem with the roller carrier, and wherein the push rod extends from the housing of the electric motor.

* * * * *